US009777754B2

(12) United States Patent
Larkin et al.

(10) Patent No.: US 9,777,754 B2
(45) Date of Patent: Oct. 3, 2017

(54) CRIMPLESS PISTON-SLIPPER ASSEMBLY

(71) Applicant: Parker-Hannifin Corporation, Cleveland, OH (US)

(72) Inventors: Bruce Larkin, Plainwell, MI (US); Daniel Dyminski, Portage, MI (US)

(73) Assignee: PARKER-HANNIFIN CORPORATION, Cleveland, OH (US)

( * ) Notice: Subject to any disclaimer, the term of this patent is extended or adjusted under 35 U.S.C. 154(b) by 419 days.

(21) Appl. No.: 14/437,243

(22) PCT Filed: Oct. 25, 2013

(86) PCT No.: PCT/US2013/066813
§ 371 (c)(1),
(2) Date: Apr. 21, 2015

(87) PCT Pub. No.: WO2014/070605
PCT Pub. Date: May 8, 2014

(65) Prior Publication Data

US 2015/0275935 A1 Oct. 1, 2015

Related U.S. Application Data

(60) Provisional application No. 61/721,095, filed on Nov. 1, 2012.

(51) Int. Cl.

| | |
|---|---|
| ***F15B 15/14*** | (2006.01) |
| ***F04B 1/20*** | (2006.01) |
| ***F04B 1/32*** | (2006.01) |

(52) U.S. Cl.
CPC ..... *F15B 15/1447* (2013.01); *F04B 1/2092* (2013.01); *F04B 1/324* (2013.01); *Y10T 29/49236* (2015.01)

(58) Field of Classification Search
CPC ..... F04B 1/324; F04B 1/2092; F15B 15/1447
USPC ..... 92/187
See application file for complete search history.

(56) References Cited

U.S. PATENT DOCUMENTS

| | | | | |
|---|---|---|---|---|
| 5,490,446 | A * | 2/1996 | Engel | F04B 1/124 29/888.047 |
| 5,758,566 | A | 6/1998 | Jepsen et al. | |
| 6,220,144 | B1 * | 4/2001 | Manring | F01B 3/0044 92/57 |
| 6,257,119 | B1 | 7/2001 | Ryken et al. | |

(Continued)

FOREIGN PATENT DOCUMENTS

| | | |
|---|---|---|
| DE | 10008970 | 3/2001 |
| EP | 1225349 | 7/2002 |
| WO | 9842949 | 10/1998 |

OTHER PUBLICATIONS

International Search Report and Written Opinion for corresponding Patent Application No. PCT/2013/066813 dated Feb. 12, 2014.

*Primary Examiner* — Thomas E Lazo
(74) *Attorney, Agent, or Firm* — Renner, Otto, Boisselle & Sklar, LLP.

(57) ABSTRACT

A piston-slipper assembly and method for assembling a piston-slipper assembly for use in a hydraulic apparatus such as a piston motor or piston pump. The assembly contains a piston and a slipper, and at least one of the piston or the slipper includes a ball and the other includes a socket. The ball is retained in the socket without crimping, swaging or bending of the socket.

20 Claims, 19 Drawing Sheets

(56) References Cited

U.S. PATENT DOCUMENTS

| | | | | |
|---|---|---|---|---|
| 6,314,864 | B1 * | 11/2001 | Beck | F01B 3/0085 92/157 |
| 6,318,242 | B1 * | 11/2001 | Stoppek | B23P 15/10 29/888.042 |
| 6,431,051 | B1 * | 8/2002 | Stoppek | B22F 3/22 92/157 |
| 2003/0097927 | A1 | 5/2003 | Boone | |

* cited by examiner

CRIMPLESS PISTON-SLIPPER ASSEMBLY

RELATED APPLICATION DATA

This application is a national phase of International Application No. PCT/US2013/066813 filed Oct. 25, 2013, and published in the English language, which claims the benefit of U.S. Provisional Application No. 61/721,095 filed Nov. 1, 2012, each of which is hereby incorporated herein by reference in its entirety.

FIELD OF INVENTION

The present invention relates generally to piston pumps and motors and more particularly to a piston-slipper assembly used in piston pumps and motors, wherein such assembly has a ball and socket combination that avoids the need for crimping, swaging or bending of the socket to retain the ball in the socket.

BACKGROUND

Axial piston pumps and motors are used to power machines or hydraulic and other fluid systems of machines. Piston-slipper assemblies are a component of axial piston pumps and motors. These assemblies take the form of at least two connected components, a piston and a slipper, one with a ball and one with a socket. Existing axial piston-slipper assemblies are crimped, swaged, or bent in order to retain the ball in the socket. Such crimping, swaging or bending can result in damage to coatings on the operable surfaces of the ball and the socket.

SUMMARY OF INVENTION

The present invention provides a piston-slipper assembly and method for assembling a piston-slipper assembly for use in a hydraulic apparatus such as a piston motor or piston pump. The assembly contains a piston and a slipper, and at least one of the piston or the slipper includes a ball and the other includes a socket. The ball is retained in the socket without crimping, swaging or bending of the socket.

Additionally, coatings may be applied to the operable surfaces of the ball and the socket. Without crimping, swaging or bending of the socket, these coatings may have a lower risk of being damaged. Particularly, a diamond-like coating is applied to at least one of the operable surfaces of the ball or the socket. Such a coating may lower friction and may increase the overall efficiency, for example by 2% to 4%, of pumps or motors using crimpless piston-slipper assemblies according to the present invention.

According to one aspect of the invention, a piston-slipper assembly, particularly for use in a hydraulic apparatus having a swash plate operably associated with a slipper, comprises a first member, having a ball portion and an axially extending neck portion, and a second member, having a socket having a circumferential extent greater than 180-degrees for receiving and retaining the ball portion in the socket while allowing swiveling movement of the ball portion. The second member has a slot in a sidewall for allowing passage of the ball portion and the axially extending neck portion when in a first orientation and precluding removal of the ball portion when in a second orientation.

More particularly, the piston-slipper assembly comprises a first member including a ball portion having a ball diameter and an axially extending neck portion having a width less than the ball diameter, and a second member having a socket configured to receive and retain the ball portion for relative rotational movement. The socket opens along an axis of the socket to an end face of the second member at an opening having a diameter less than the diameter of the ball portion for retaining the ball portion in the socket while allowing swiveling movement of the ball portion within the socket. The ball portion has reliefs provided at diametrically opposed sides of the ball portion that are aligned along a ball diameter of the ball portion perpendicular to the axis of the axially extending neck portion. The reliefs define a reduced diameter portion of the ball portion having a width through the center of the ball portion less than the ball diameter of the ball portion and less than the diameter of the opening. The second member has extending through a side wall thereof a slot that opens to the end face of the second member and has a width greater than the width of the neck portion of the first member, whereby the neck portion can move into the slot to allow the reduced width portion of the ball portion to move through the opening into the socket when the neck portion and the reduced diameter portion of the ball portion are oriented substantially perpendicular to the axis of the socket, after which the neck portion can be rotated out of the slot so that the ball portion will be retained in the socket.

The reliefs may be formed by a flats, grooves or detents on the sides of the ball portion.

The axially extending neck portion may be cylindrical or of another cross-sectional shape.

The first member or the second member may be a piston of a hydraulic apparatus, and the other may be a slipper of a hydraulic apparatus.

The ball portion and socket have confronting operable surfaces, and at least one of the operable surfaces may be coated, such as with a diamond-like material, or made of a material having high resistance to flaking or chipping for improving wear resistance and/or reducing heat and friction.

According to another aspect of the invention, there is provided a hydraulic apparatus including one or more of the aforesaid piston-slipper assemblies and a swash plate operably associated with the one or more piston-slipper assemblies.

According to a further aspect of the invention, a method for assembling a piston-slipper assembly of a hydraulic apparatus includes the steps of aligning in a first orientation an axially extending neck portion of a first member with a slot in a side wall of a socket of a second member, passing a ball portion of the first member into the socket of the second member, and aligning in a second orientation the axially extending neck portion thereby precluding removal of the ball portion from the socket.

As can now be appreciated, a piston-slipper assembly can be assembled without the need to crimp, swage or bend the socket.

The foregoing and other features of the invention are hereinafter described in greater detail with reference to the accompanying drawings.

DETAILED DESCRIPTION

Piston-slipper assemblies are utilized in axial piston pumps and motors used to power machines or hydraulic and other fluid systems of machines. Oftentimes, such piston-slipper assemblies take the form of at least two connected components, a piston and a slipper, one having a ball and the other having a socket.

The present invention, for use in a hydraulic apparatus, relates to such piston-slipper assemblies with one of a piston or a slipper having a ball and the other having a socket. More particularly, the ball of a piston-slipper assembly of the present invention is retained in the socket without any crimping, swaging, bending, or other mechanical manipulation of the socket. Damage to operable surfaces of the ball and socket that typically occurs during such mechanical manipulation is avoided and a greater ease of manufacturing, lower manufacturing cost, and improved repairability are achieved. A coating, which would otherwise become damaged during mechanical manipulation of the socket, may be applied to the operable surfaces of the ball and the socket. Such coatings may reduce heat and friction and improve wear resistance of operable surfaces due to a lower risk of breaking and degeneration of such coatings, thus leading to greater overall pump or motor efficiency of a hydraulic apparatus utilizing the aforementioned piston-slipper assemblies. Particularly, such coatings may be made of a diamond-like material or another suitable material having high resistance to flaking or chipping known to one of ordinary skill in the art.

Figure 1:
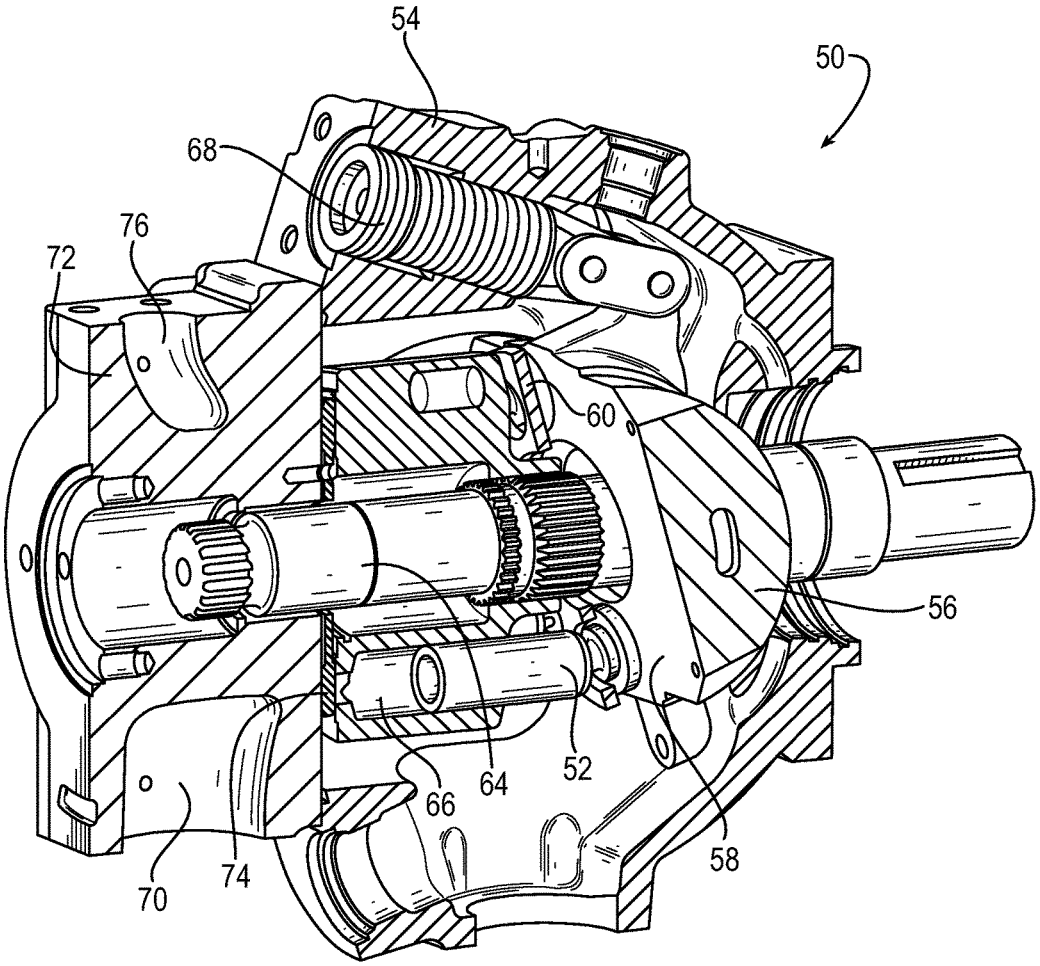
FIG. 1 is a perspective view partially broken away of a hydraulic apparatus employing piston-slipper assemblies according to the present invention.

Turning first to FIG. 1, an exemplary hydraulic apparatus 50 can be seen to include a plurality of piston-slipper assemblies 52. The hydraulic apparatus 50 may be operative as a piston pump or alternatively as a piston motor. The hydraulic apparatus 50 may be of the axial, variable delivery axial, or bent-axis type, or any other appropriate type of pump or motor known to one of ordinary skill in the art. As conventionally known, the hydraulic apparatus 50 includes a housing 54 and a control plate 56, such as a swash plate, operably associated with the plurality of the piston-slipper assemblies 52. The piston-slipper assemblies 52 may be held in communication with a wear plate 58 associated with the control plate 56 by a shoe retainer plate 60, and the piston-slipper assemblies 52 may have surfaces or faces for mating with at least one of these plates.

The piston-slipper assemblies 52 together with a cylinder block 62 may rotate about a shaft 64. Reciprocating motions of the piston-slipper assemblies 52 within the cylinder block 62 may cause fluid to be drawn into each cylinder 66 of the cylinder block 62 and then expelled. This pumping may generate increasing and decreasing volumes of fluid. The reciprocating motion may be controlled by the angling of the control plate 56. It will be understood by one having ordinary skill in the art that angling of the cylinder block 62 relative to the control plate 56 may permit additional control of reciprocating motions. The control plate 56 may be angled via interaction of an operating assembly 68. The operating assembly 68 may contain operating components, such as springs, rods, or linkages, and may be operated by a mechanism (not shown) external to the hydraulic apparatus 50. Fluid may be drawn from an inlet 70 of a secondary housing 72, through a valve plate 74, and subsequently pumped into the cylinders 66. The fluid may then be pumped out of the cylinders 66 by the reciprocating motions of the piston-slipper assemblies 52 operative with the cylinder block 62. Subsequently, fluid may be pumped through the valve plate 74 and out an outlet 76 of the secondary housing 72. In an opposite manner, pressurized fluid can be supplied to the apparatus for operation as a motor.

Figure 2:
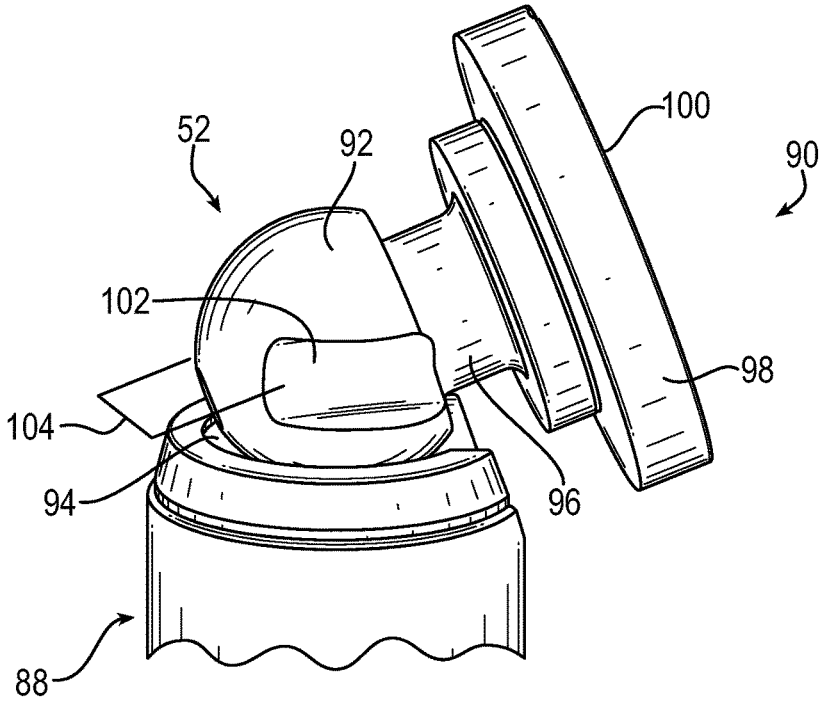
FIG. 2 is a fragmentary perspective view of a piston-slipper assembly used in the hydraulic apparatus of FIG. 1 showing the ball entering the socket.

Turning next to FIG. 2, an exemplary piston-slipper assembly 52 according to the invention can be seen to include a piston 88 and a slipper 90, and more specifically a ball portion 92 of the slipper 90 entering a socket 94 of the piston 88. Alternatively, it will be understood by one of ordinary skill in the art that the piston 88 may contain the ball portion 92 and the slipper 90 may contain the socket 94, although this construction may be less conventional. The slipper 90 has an axially extending neck portion 96 axially interposed between the ball portion 92 and a base portion 98. The neck portion 96 may be cylindrical or of another suitable cross-sectional shape and may also have a width lesser than a ball diameter of the ball portion 92. The base portion 98 may have a base surface 100 for communicating with a control plate 56 or wear plate 58 of a hydraulic apparatus, such as the hydraulic apparatus 50 shown in FIG. 1. The ball portion 92 has reliefs 102 provided at diametrically opposed sides of the ball portion 92 that are aligned along a ball diameter of the ball portion 92 perpendicular to an axis of the neck portion 96. The reliefs 102 may comprise a flat, a groove, a detent, or other physical feature suitable to one of ordinary skill in the art. The reliefs 102 also define a reduced diameter portion 104 of the ball portion 92, the reduced diameter portion 104 having a width through the center of the ball portion 92 less than the ball diameter of the ball portion 92. Accordingly, the reduced diameter portion 104 may be located along an equator of the ball portion 92.

Figure 3:
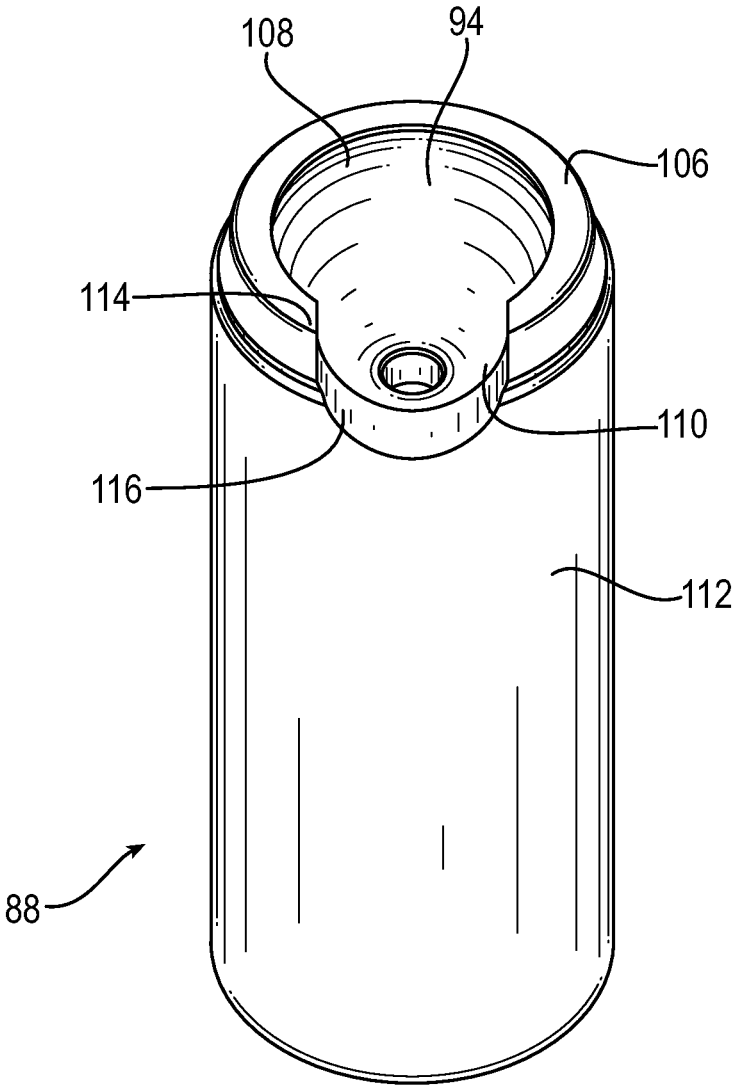
FIG. 3 is top elevational view from a different angle of a piston-slipper assembly used in the hydraulic apparatus of FIG. 1 showing a view through the ball portion.

Turning next to FIG. 3, a piston 88 can be seen to include socket 94 that opens to an end face 106 of the piston 88 at an opening 108. A slot 110 extends from the socket 94 to an external side 112 of the piston 88. The slot 110 may also open to the end face 106 at a second opening 114. Accordingly, the slot 110 may be configured such that it extends from the socket 94, through a sidewall 116 of the piston 88.

Figure 4:
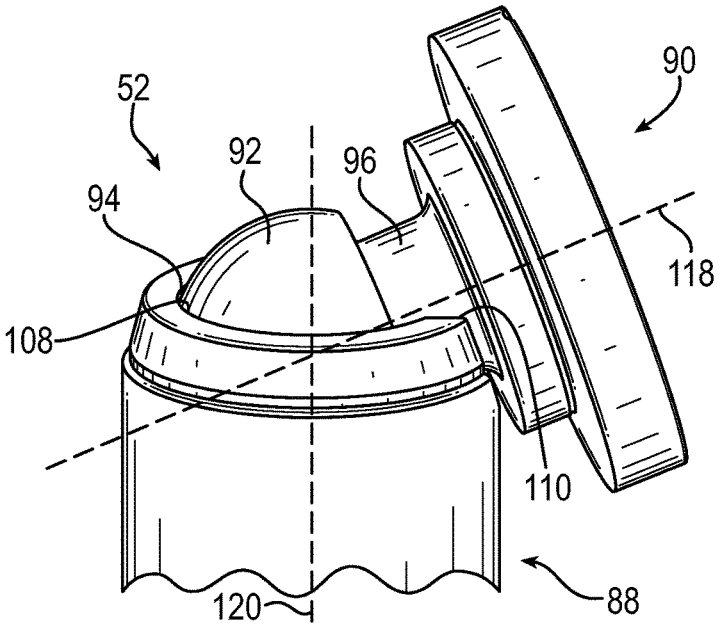
FIG. 4 is a fragmentary perspective view of a piston-slipper assembly used in the hydraulic apparatus of FIG. 1 showing the ball seated in the socket.

Turning next to FIG. 4, a slipper 90 can be seen to include a ball portion 92 seated in the socket 94 of the piston 88. The socket 94 is configured to receive and retain the ball portion 92 via a circumferential extent greater than 180-degrees extending beyond an equator of the ball portion 92, conforming to and securing the ball portion 92 in the socket 94. The socket 94 may also have a depth greater than a first radius of the ball portion 92, the first radius not corresponding to the reduced diameter portion 104. The opening 108 of the socket 94 has a diameter that is less than the ball diameter of the ball portion 92 for retaining the ball portion 92 in the socket 94 while allowing swiveling movement of the ball portion 92. The diameter of the opening 108 may also be greater than the width of the reduced diameter portion 104 through the center of the ball portion 92. The slot 110 may have a width greater than a width of the neck portion 96.

The slot 110 may allow for passage of the ball portion 92 and the neck portion 96 when the piston 88 and the slipper 90 are aligned in a first orientation. In the first orientation, an axis 118 of the neck portion 96 may be oriented transversely to an axis 120 of the piston 88 for allowing passage of the neck portion 96 into the slot 110. Thus, the first orientation may be when the reduced diameter portion 104 of the ball portion 92 is aligned with the opening 108 of the socket 94 and the neck portion 96 is aligned with the slot 110, allowing for passage of the ball portion through the opening 108 and into the socket 94, and also allowing for passage of the neck portion 96 into the slot 110.

Figure 5:
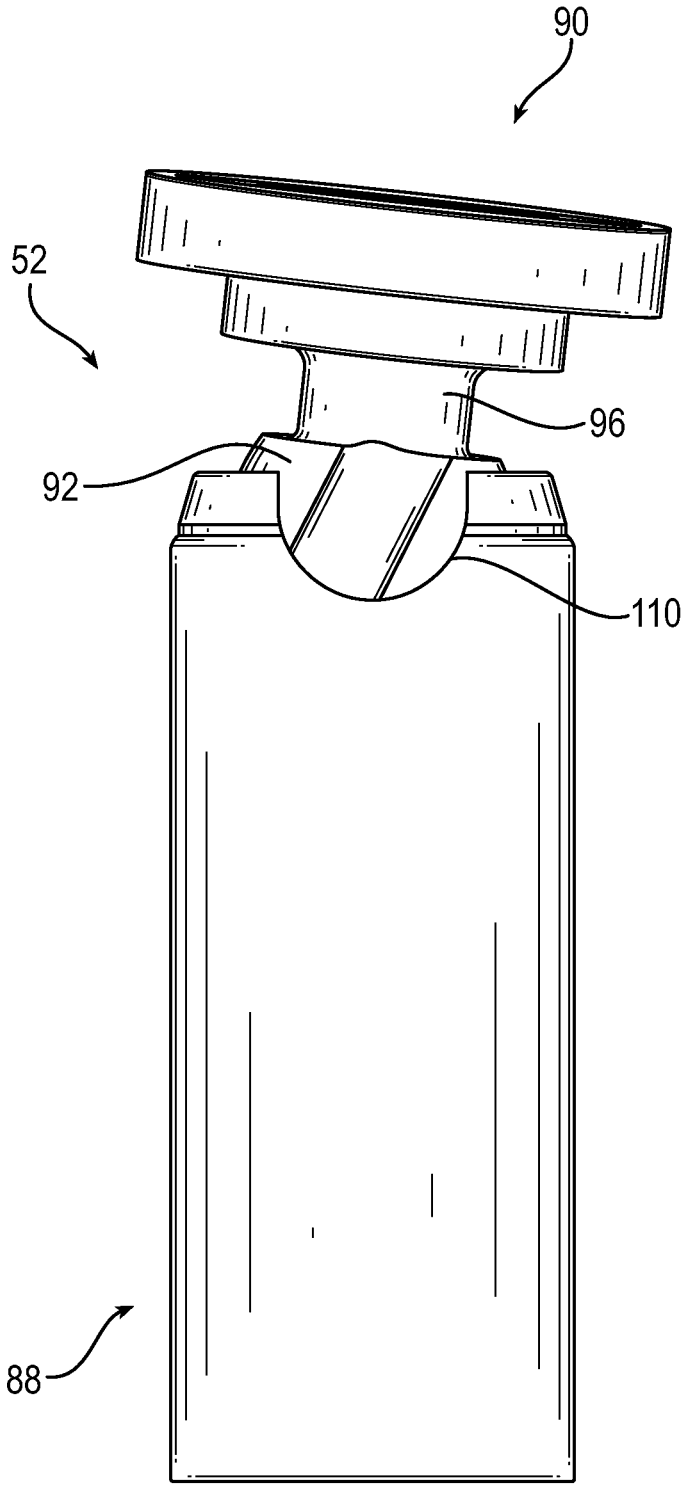
FIG. 5 is a perspective view of a piston-slipper assembly used in the hydraulic apparatus of FIG. 1 showing the piston and slipper rotated into an operative position.
Figure 6:
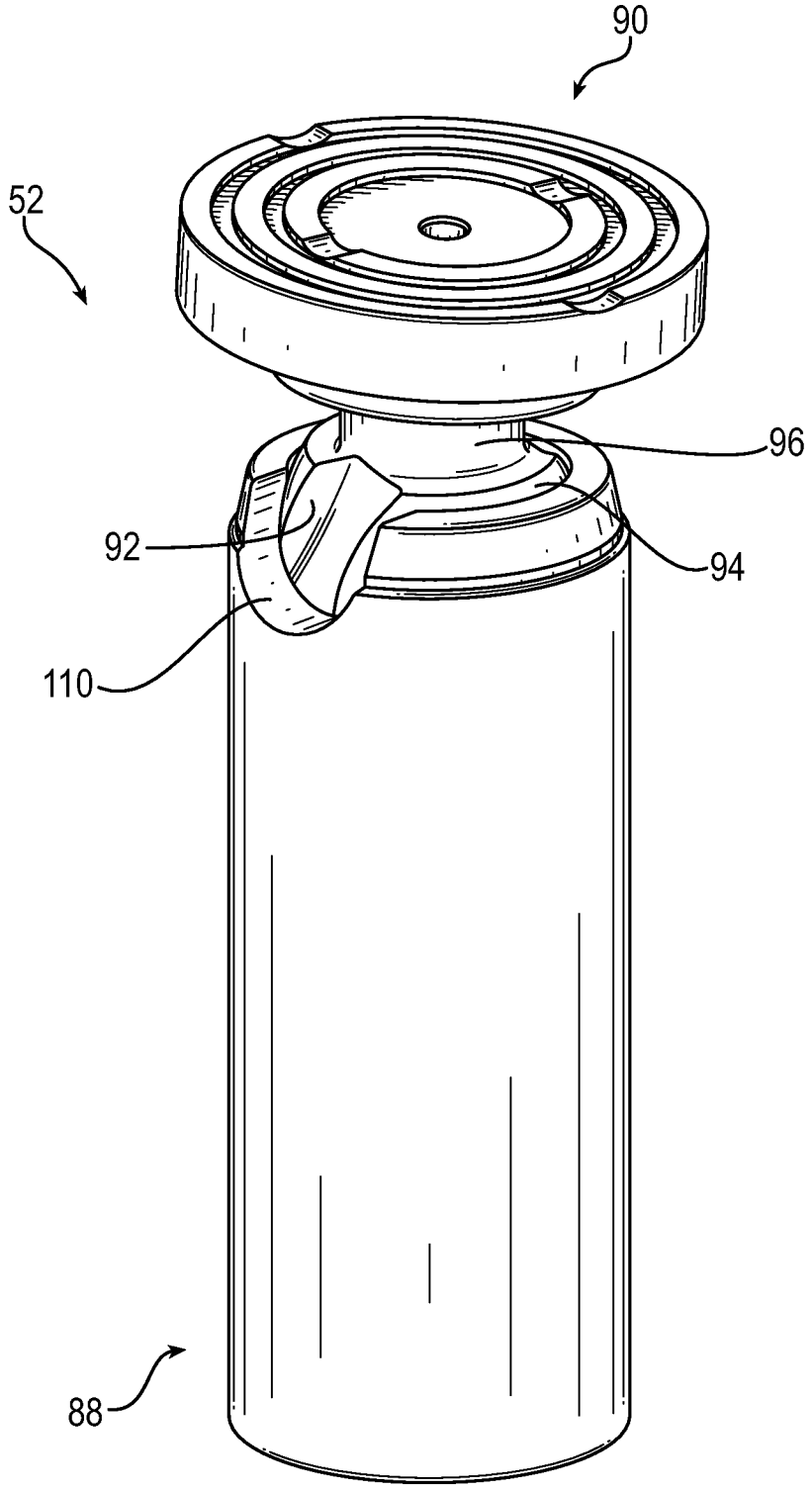
FIG. 6 is another perspective view from a different angle of a piston-slipper assembly used in the hydraulic apparatus of FIG. 1 showing the piston and slipper rotated into an operative position.

Turning now to FIGS. 5 and 6, it can be seen that removal of the ball portion 92 from the socket 94 may be precluded via rotation of the neck portion 96 out of the slot 110 and into a second orientation. In the second orientation, the piston-slipper assembly 52 is operatively positioned to be utilized in the hydraulic apparatus 50 of FIG. 1. Accordingly, no crimping, swaging, bending or other mechanical manipulation of the socket 94 may be necessary in order to assemble the piston-slipper assembly 52 and retain the ball portion 92 in the socket 94.

Figure 7:
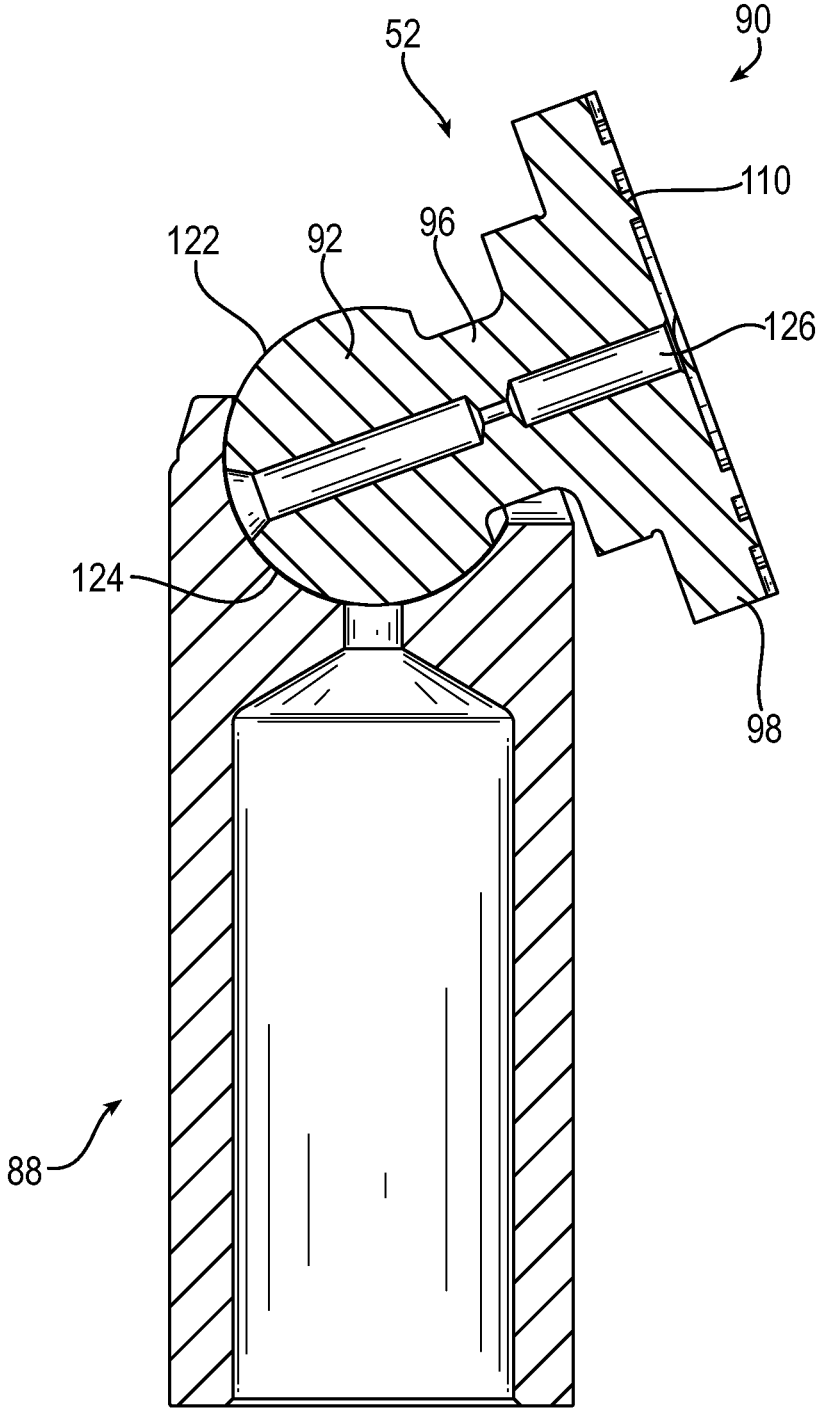
FIG. 7 is a perspective view partially broken away of a piston-slipper assembly used in the hydraulic apparatus of FIG. 1 showing the ball seated in the socket.

Turning next to FIG. 7, the ball portion 92 of the slipper 90 can be seen seated in the socket 94 of the piston 88. The ball portion 92 has a first operable surface 122 for communicating with a second operable surface 124 of the socket 94 when the ball portion 92 is engaged in the socket 94. The first operable surface 122 may be composed of a material different from a material of the slipper 90, and the second operable surface 124 may be composed of a material different from a material of the piston 88. Accordingly, because no crimping, swaging, bending or other similar mechanical act of the socket 94 may be necessary in order to retain the ball portion 92 in the socket 94, the first and second operable surfaces 122, 124 may be formed by coatings. At least one of the first operable surface 122 or the second operable surface 124 may be composed of a material having high resistance to flaking or chipping for improving wear resistance and reducing heat and friction, such as a diamond-like material or other suitable material available to one having ordinary skill in the art.

The slipper 90 may also include an axially extending first passage 126 for delivering fluid or lubricant to the socket 94 of the piston 88. The first passage 126 may extend from the base surface 100, through the base portion 98 and the neck portion 96, and additionally through the ball portion 92 to the operable surface 122.

Figure 8:
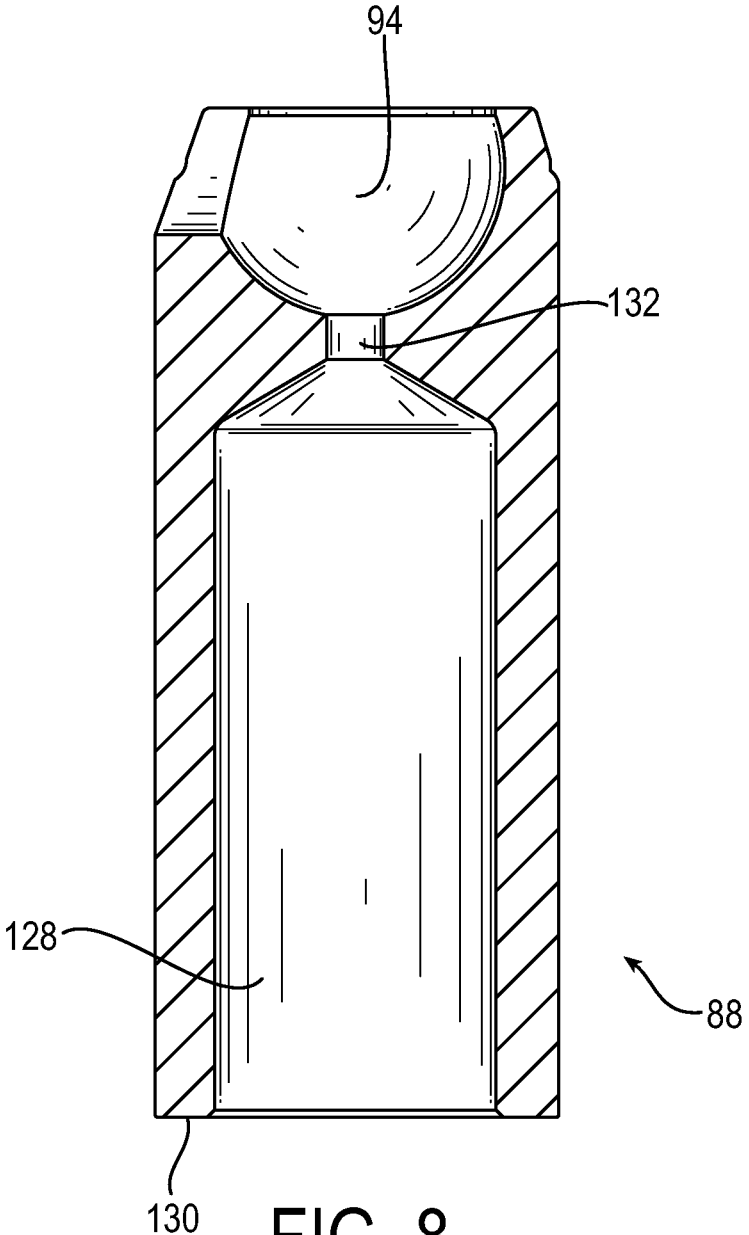
FIG. 8 is a perspective view partially broken away of a piston-slipper assembly used in the hydraulic apparatus of FIG. 1 showing a view through the ball portion.
Figure 9:
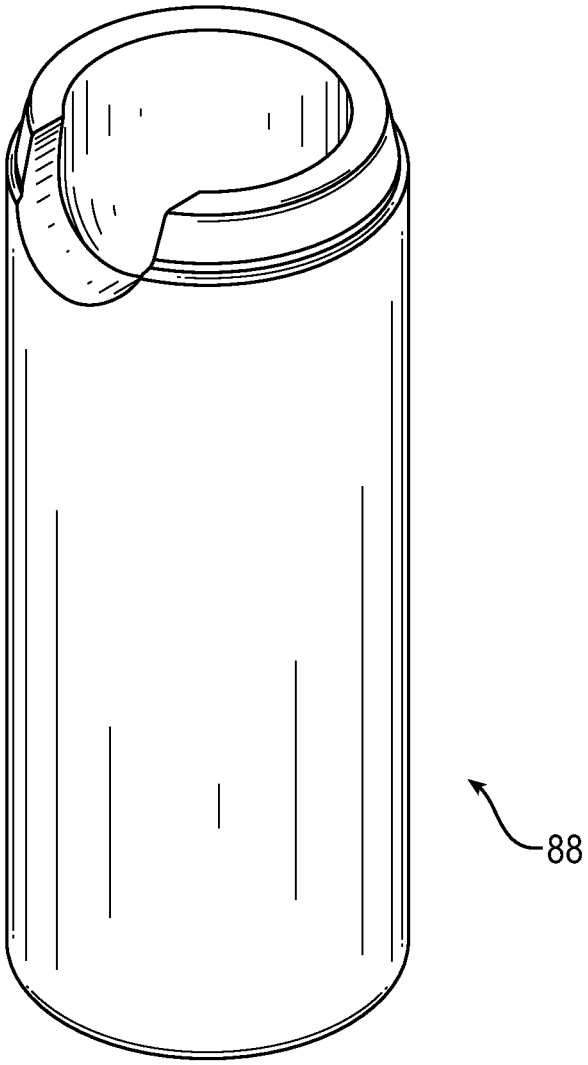
FIG. 9 is a perspective view from a different angle of a piston-slipper assembly used in the hydraulic apparatus of FIG. 1 showing a view through the ball portion.
Figure 10:
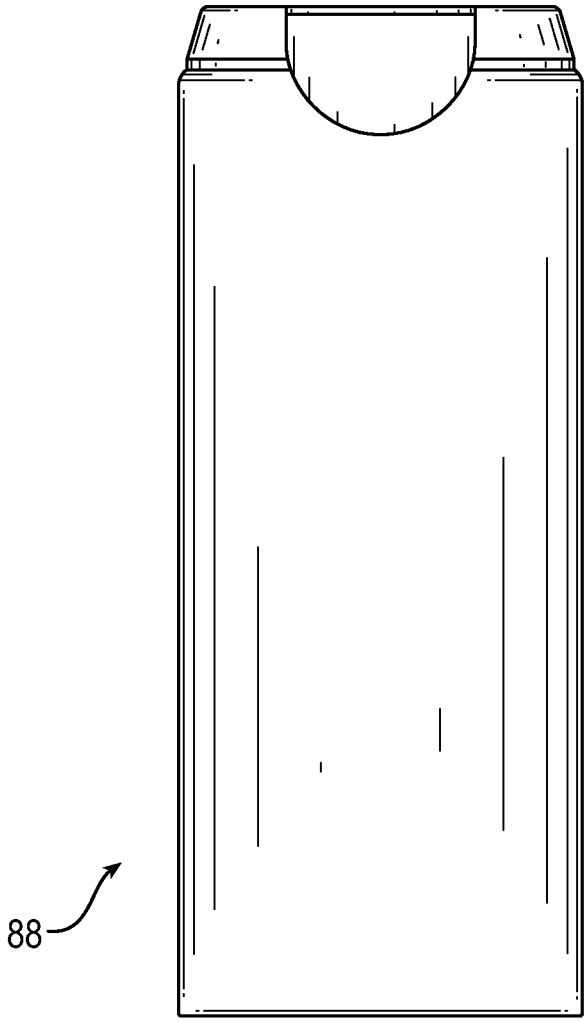
FIG. 10 is another perspective view from a different angle of a piston-slipper assembly used in the hydraulic apparatus of FIG. 1 showing a view through the ball portion.

Turning now to FIGS. 8-10, an embodiment of the piston 88 can be seen to include a fluid cavity 128 opening to a bottom face 130 for receiving fluid from the inlet 70 and delivering fluid to the outlet 76 of the secondary housing 72 of the hydraulic apparatus 50 of FIG. 1. The piston 88 may further include an axially extending second passage 132 disposed between and for providing fluid communication between the fluid cavity 128 and the socket 94.

Figure 11:
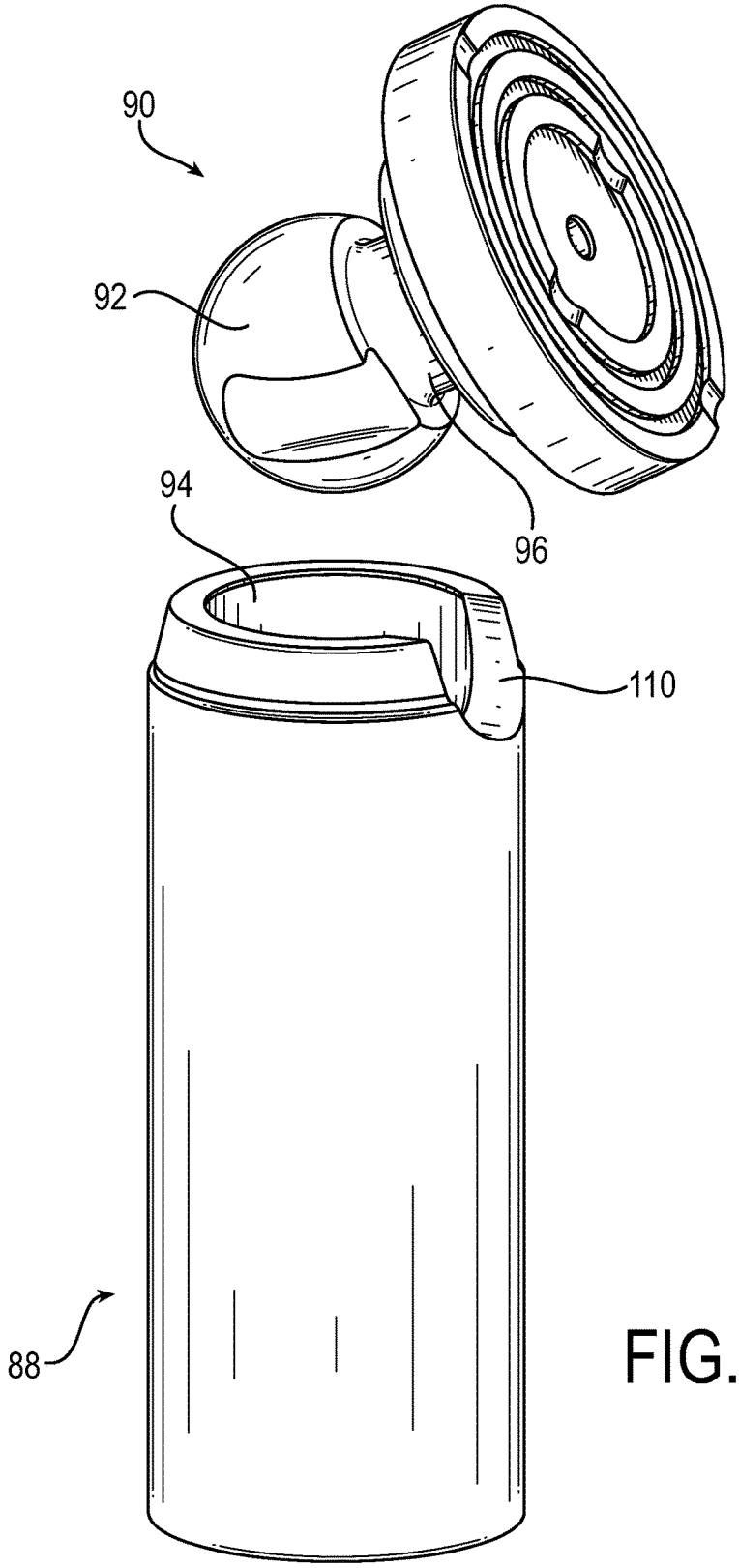
FIGS. 11-18 are perspective views showing the progression of the assembly of a ball being seated in a socket to form the exemplary piston-slipper assembly used in the hydraulic apparatus of FIG. 1.
Figure 12A:
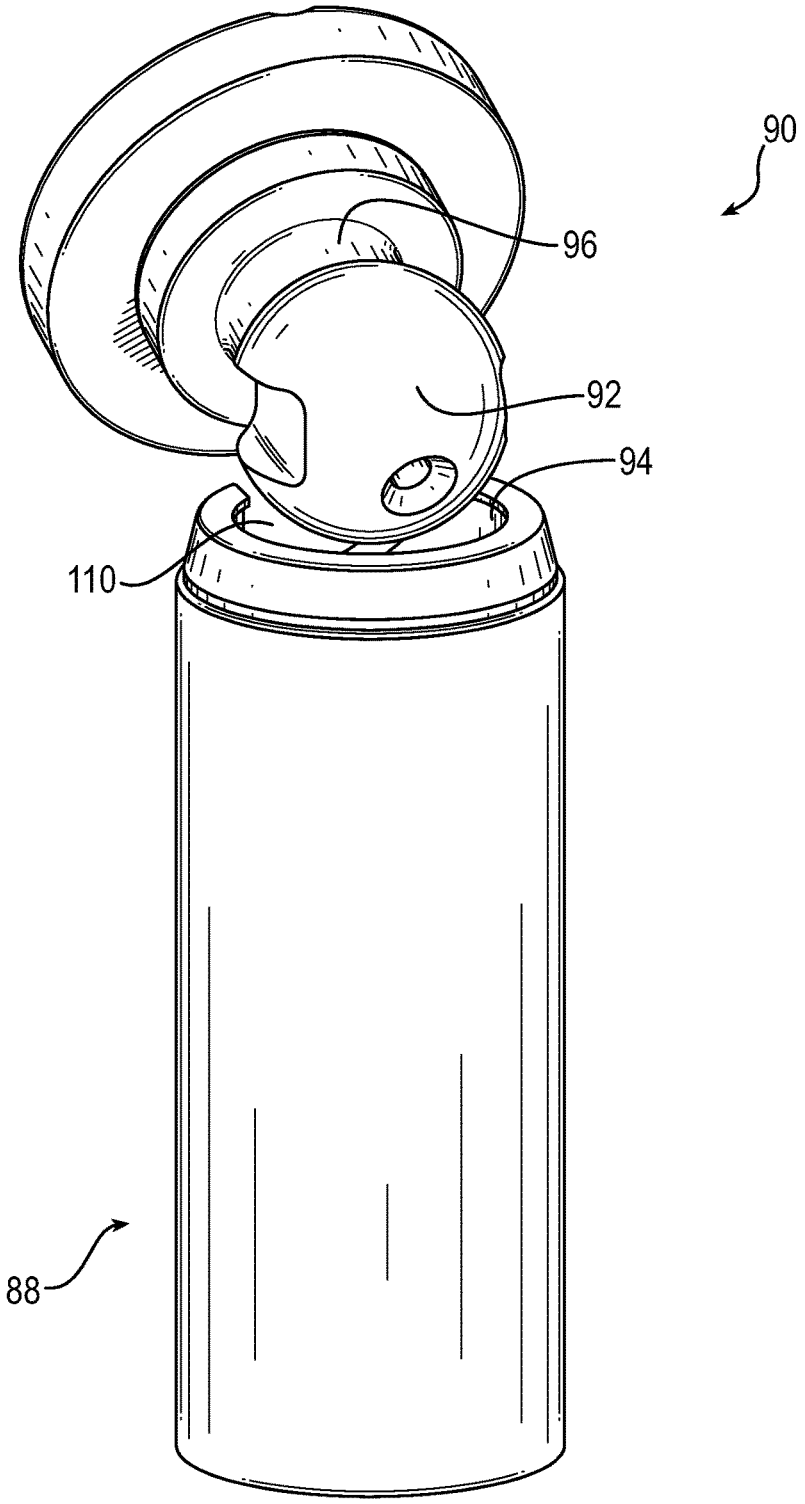
Figure 12B:
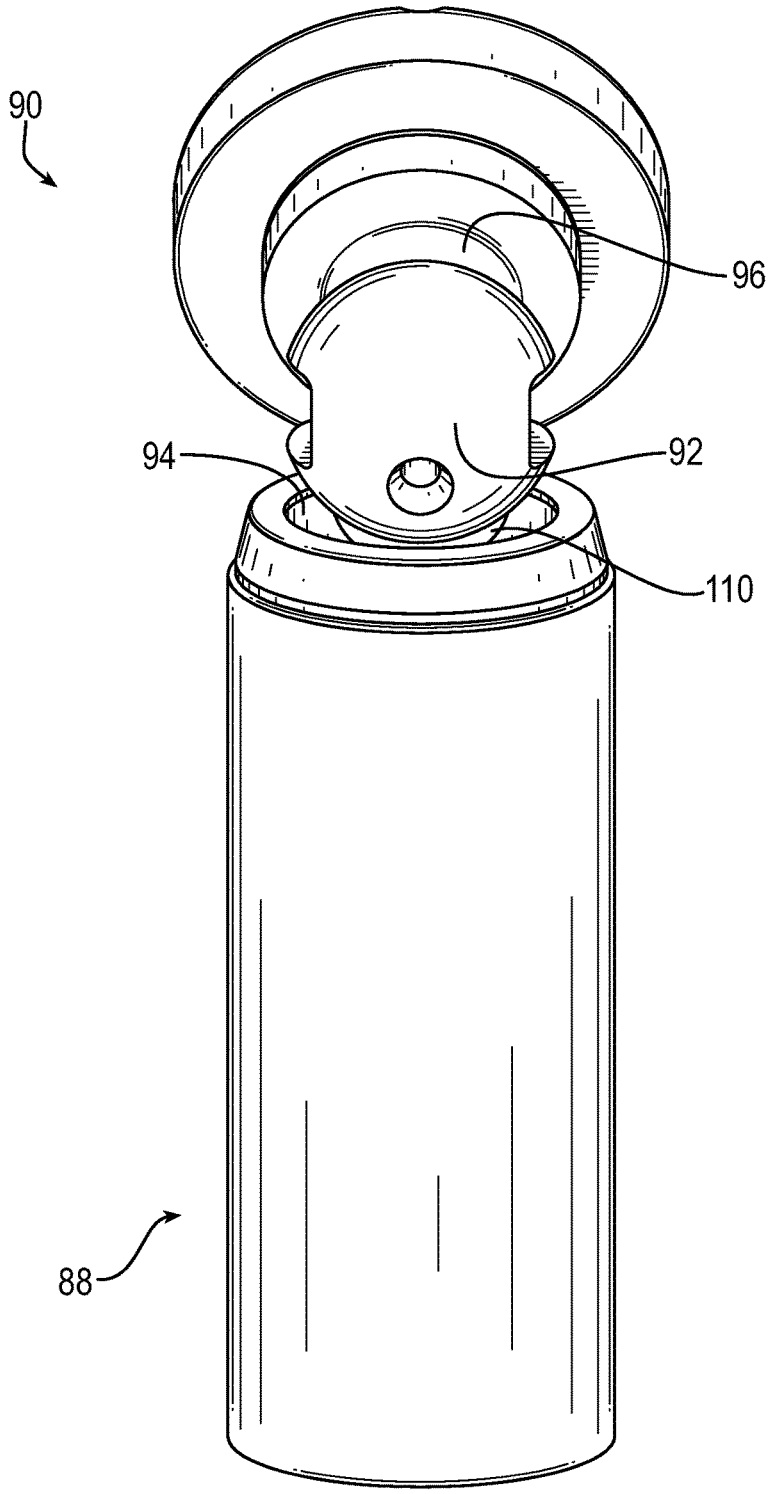
Figure 12C:
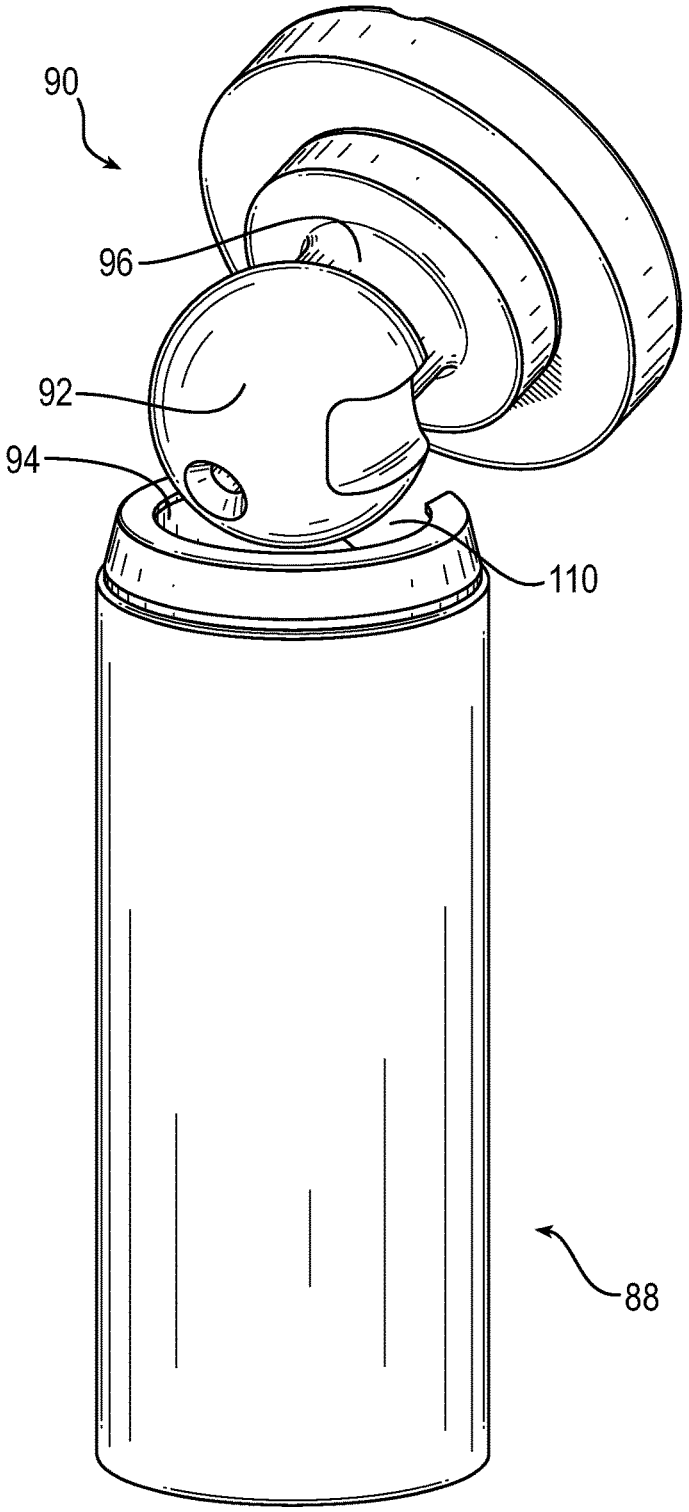
Figure 13:
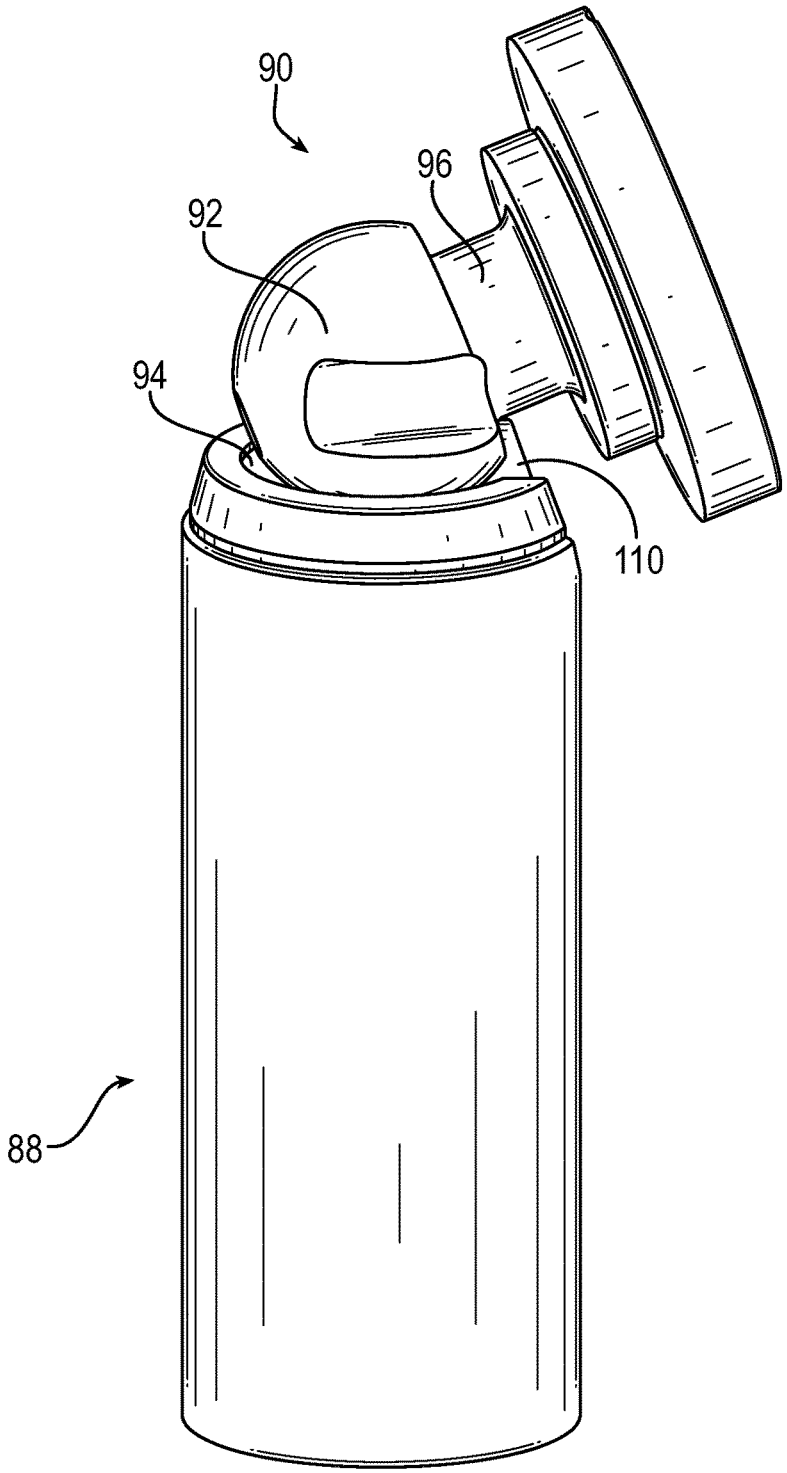
Figure 14:
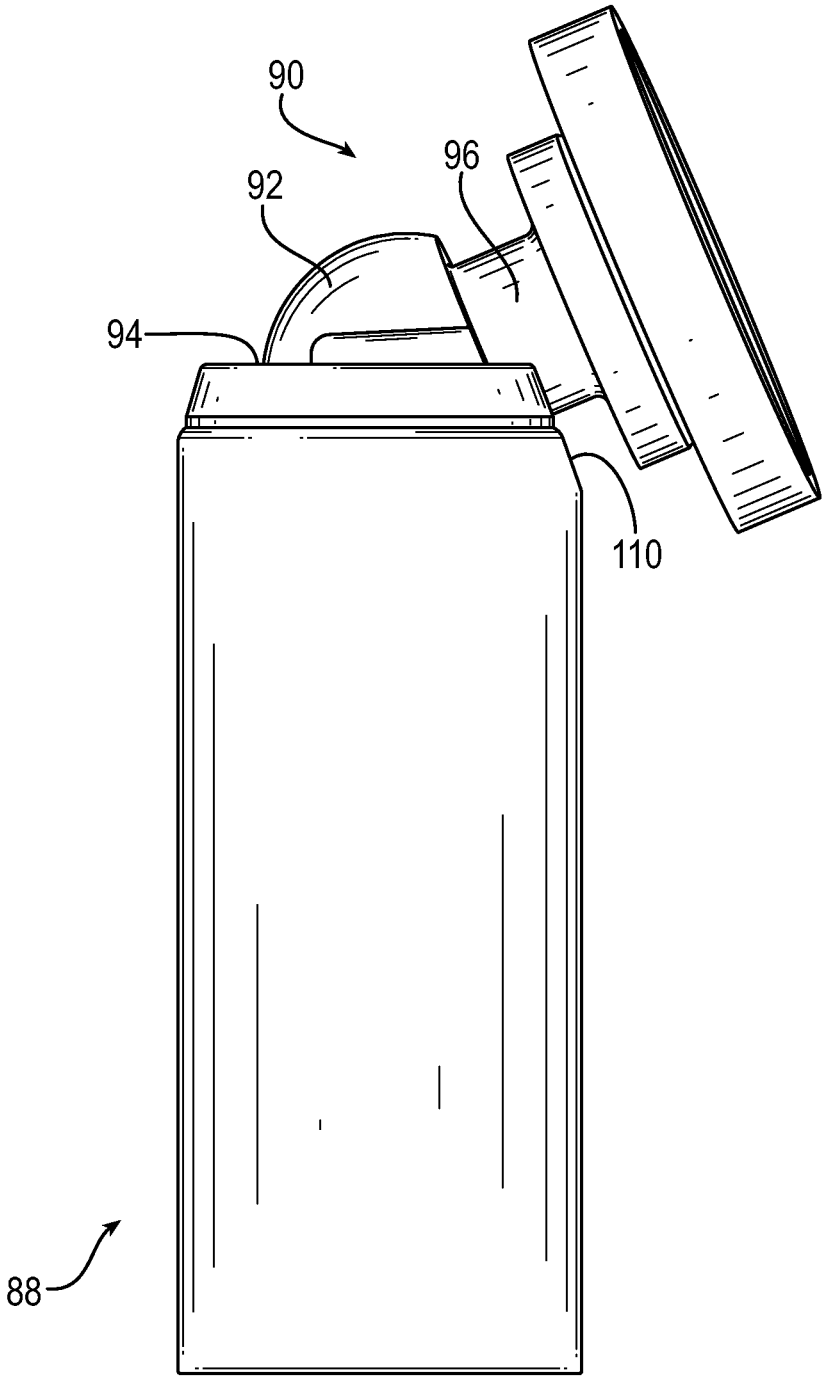
Figure 15:
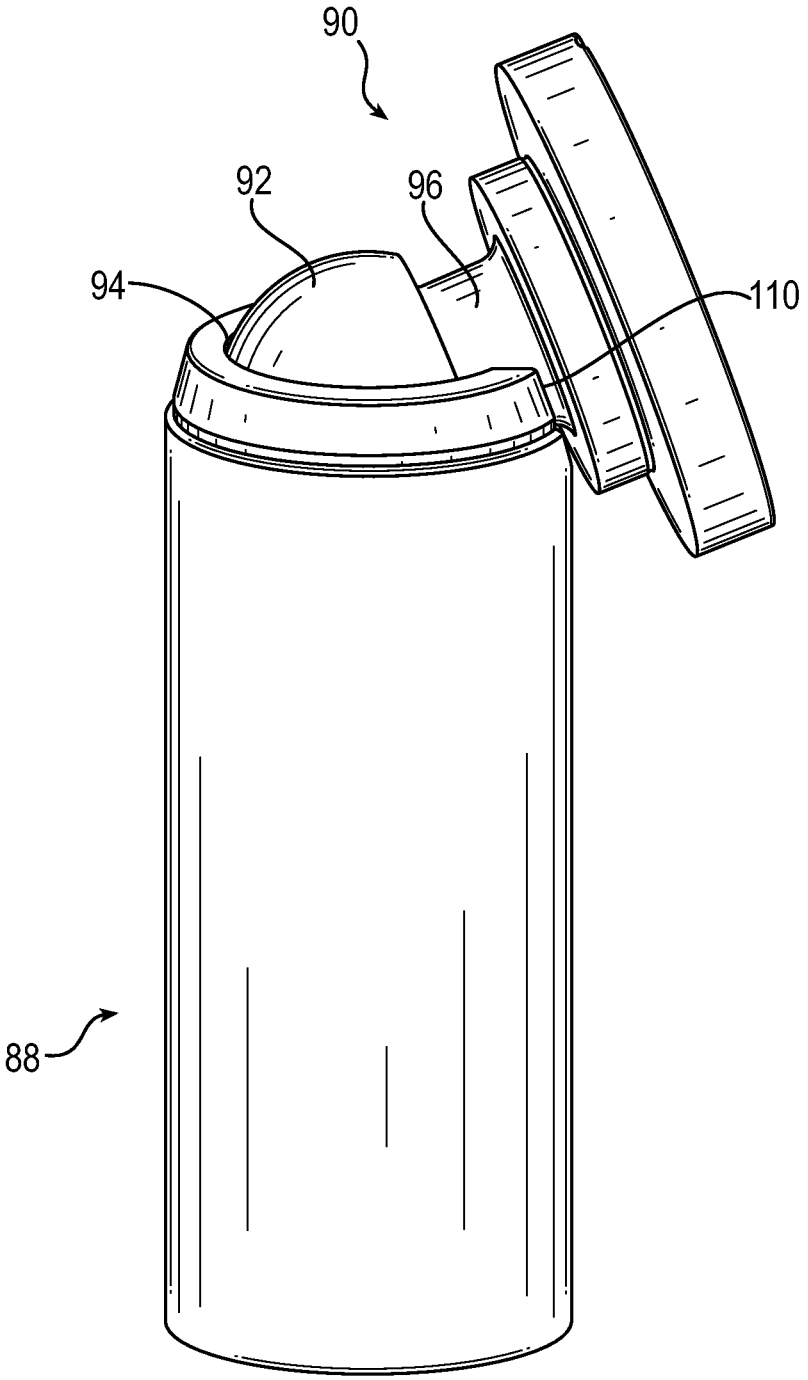
Figure 16:
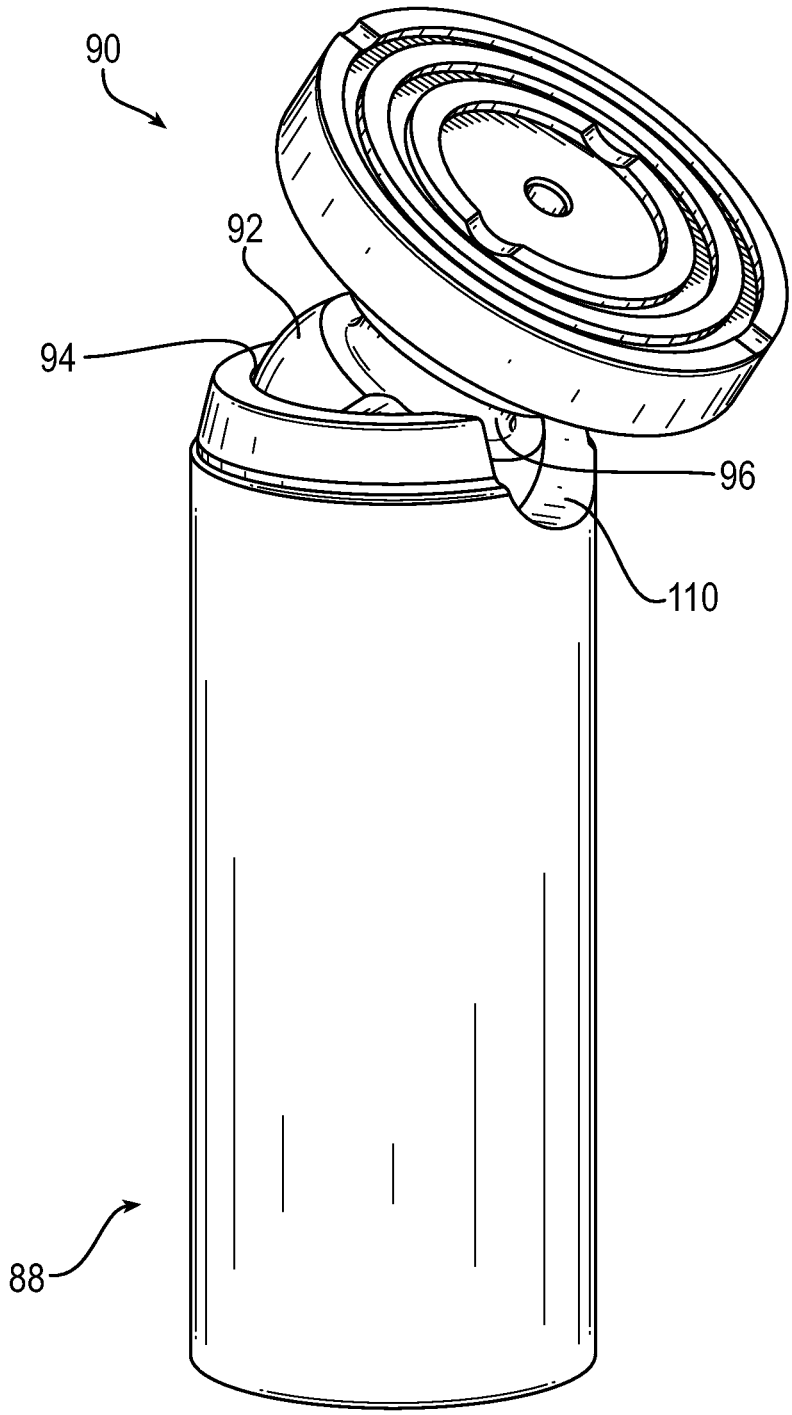
Figure 17:
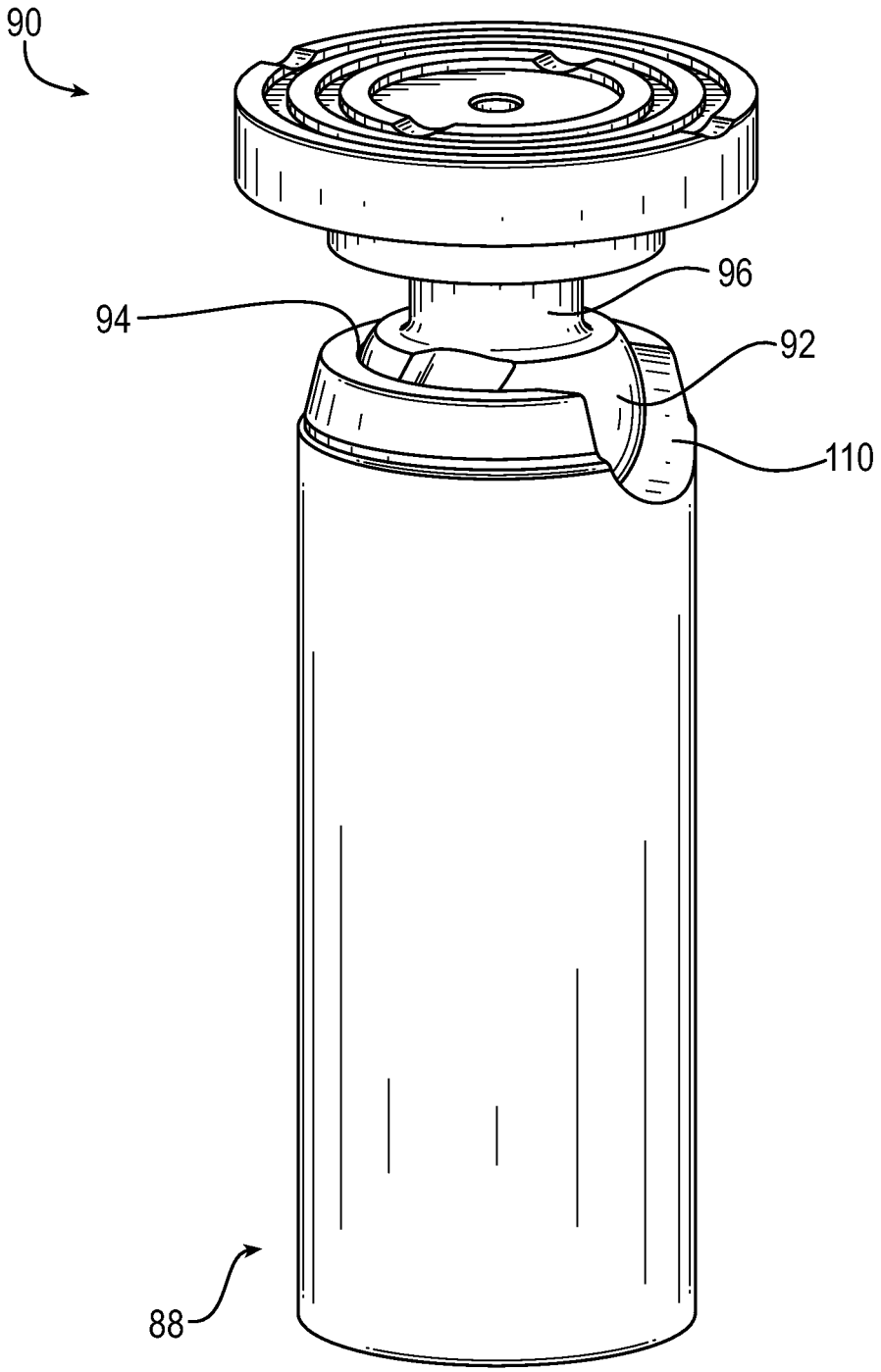
Figure 18:
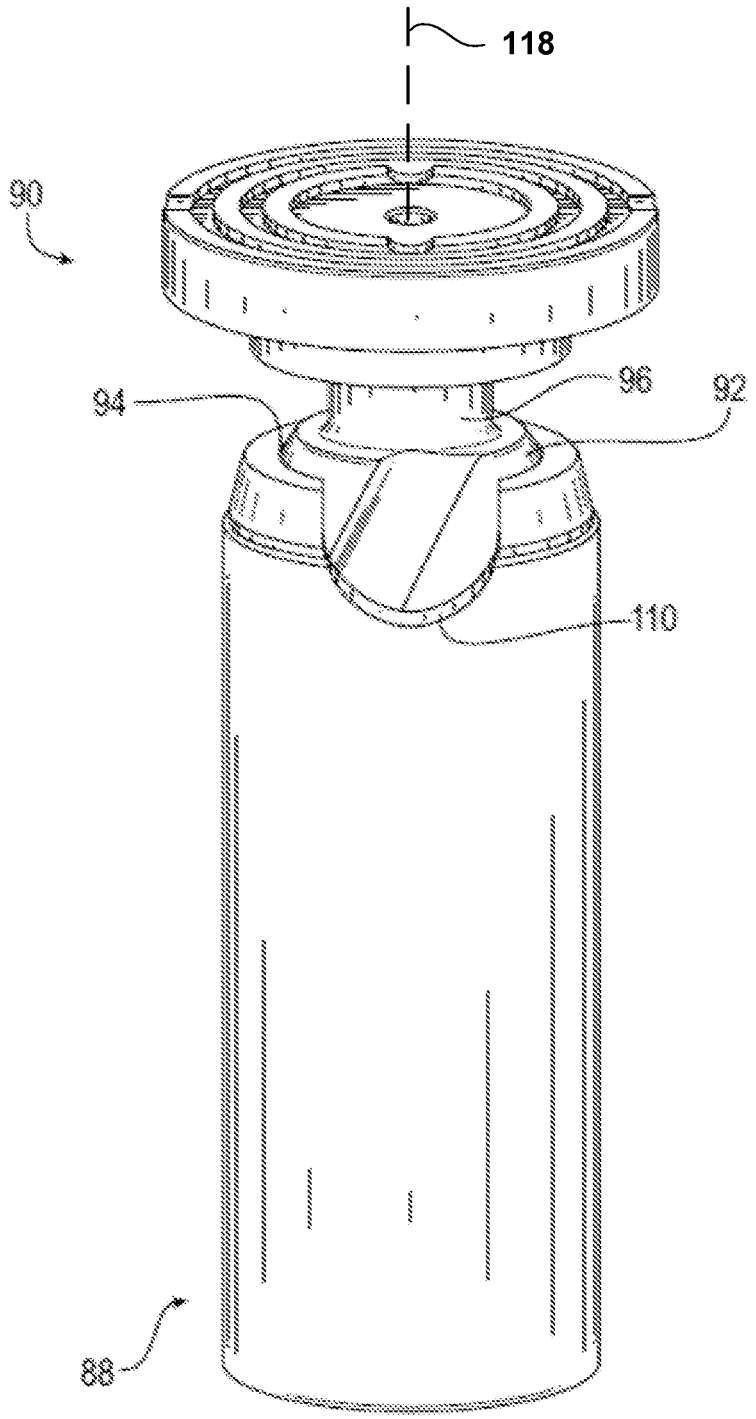

Turning next to FIGS. 11-18, the assembling of the slipper 90 into the piston 88 to for the piston-slipper assembly 52 is shown in progressive steps. FIG. 11 shows the slipper 90 and the piston 88 separate from one another. FIGS. 12-15 show the progression of the ball portion 92 and the neck portion 96 of the slipper 90 being aligned and passed into the socket 94 and slot 110, and thereby into the first orientation. FIG. 16 shows the neck portion 96 being rotated out of the slot 110 and into the second orientation shown in FIG. 17, thereby precluding removal of the ball portion 92 from the socket 94. As shown in FIG. 18, the slipper 90 has been rotated about the axis 118 of the longitudinally extending neck portion 96, and the ball portion 92 remains precluded from removal from the socket 94 and through the opening 108.

Although the invention has been shown and described with respect to a certain preferred embodiment or embodiments, it is obvious that equivalent alterations and modifications will occur to others skilled in the art upon the reading and understanding of this specification and the drawings. In particular, in regard to the various functions performed by the above described elements (components, assemblies, devices, compositions, etc.), the terms used to describe such elements are intended to correspond, unless otherwise indicated, to any element which performs the specified function of the described element (i.e., that is functionally equivalent). In addition, while a particular feature of the invention may have been described above with respect to only one or more of several illustrated embodiments, such feature may be combined with one or more other features of the other embodiments, as may be desired and advantageous for any given or particular application.

The invention claimed is:

1. A piston-slipper assembly for use in a hydraulic apparatus having a plate operably associated with a slipper, the piston-slipper assembly comprising:

a first member having a ball portion with a ball diameter and having an axially extending neck portion; and a second member having a socket configured to receive and retain the ball portion;

wherein the socket opens to an end face at an opening having a diameter less than the ball diameter of the ball portion for retaining the ball portion in the socket while allowing swiveling movement of the ball portion;

wherein the ball portion has reliefs provided at diametrically opposed sides of the ball portion that are aligned along a ball diameter of the ball portion perpendicular to an axis of the axially extending neck portion of the first member, wherein the reliefs define a reduced diameter portion of the ball portion having a relief width disposed through a center of the ball portion that is less than the ball diameter of the ball portion and less than the diameter of the opening;

wherein the second member has a slot extending from the socket to an external side of the second member for receiving the axially extending neck portion for allowing passage of the reduced diameter portion; and wherein the axially extending neck portion can move into the slot and the ball portion can move into the socket when the axially extending neck portion is aligned with slot and the reduced diameter portion is aligned with the opening, after which the axially extending neck portion can be moved out of the slot thereby locking the ball portion in the socket.

2. The piston-slipper assembly of claim 1, wherein the slot has a width greater than a width of the axially extending neck portion.

3. The piston-slipper assembly of claim 1, wherein the slot opens to the end face at a second opening defining a width greater than a width of the axially extending neck portion.

4. The piston-slipper assembly claim 1, wherein the axis of the axially extending neck portion is oriented transversely to an axis of the second member for allowing passage of the axially extending neck portion.

5. The piston-slipper assembly of claim 1, wherein the ball diameter of the ball portion is greater than a width of the axially extending neck portion.

6. The piston-slipper assembly of claim 1, wherein one of the first member or the second member is a piston of the hydraulic apparatus, and the other of the first member or the second member is a slipper of the hydraulic apparatus.

7. The piston-slipper assembly of claim 1, wherein the ball portion has a first operable surface for communicating with a second operable surface of the socket, and wherein at least one of the first operable surface or the second operable surface comprises a diamond-like material.

8. A piston-slipper assembly for use in a hydraulic apparatus having a plate operably associated with a slipper, the piston-slipper assembly comprising:

a first member having a ball portion and an axially extending neck portion; and a second member having a socket having a circumferential extent greater than 180-degrees for receiving and retaining the ball portion in the socket while allowing swiveling movement of the ball portion; and the second member having a slot in a sidewall for allowing passage of the ball portion and the axially extending neck portion when in a first orientation and precluding removal of the ball portion when in a second orientation.

9. The piston-slipper assembly of claim 8, wherein the socket opens to an end face at an opening having a diameter less than a ball diameter of the ball portion for retaining the ball portion in the socket.

10. The piston-slipper assembly of claim 8, wherein the slot opens to an end face at a second opening defining a width greater than a width of the axially extending neck portion.

11. The piston-slipper assembly of claim 8, wherein the ball portion has reliefs provided at diametrically opposed sides of the ball portion that are aligned along a ball diameter of the ball portion perpendicular to an axis of the axially extending neck portion of the first member, and wherein the reliefs define a reduced diameter portion of the ball portion having a relief width disposed through the center of the ball portion that is less than the ball diameter of the ball portion for allowing passage of the ball portion into the socket.

12. The piston-slipper assembly of claim 8, wherein the slot has a width greater than a width of the axially extending neck portion.

13. The piston-slipper assembly of claim 8, wherein an axis of the axially extending neck portion is oriented transversely to an axis of the second member for allowing passage of the axially extending neck portion.

14. The piston-slipper assembly of claim 8, wherein the axially extending neck portion is cylindrical.

15. The piston-slipper assembly of claim 8, wherein a ball diameter of the ball portion is greater than a width of the axially extending neck portion.

16. The piston-slipper assembly of claim 8, wherein one of the first member or the second member is a piston of the hydraulic apparatus, and the other of the first member or the second member is a slipper of the hydraulic apparatus.

17. The piston-slipper assembly of claim 8, wherein the ball portion has a first operable surface for communicating with a second operable surface of the socket, and wherein at least one of the first operable surface or the second operable surface comprises a diamond-like material.

18. A hydraulic apparatus comprising:

a plurality of piston-slipper assemblies according to claim 8; and a control plate operably associated with the plurality of the piston-slipper assemblies.

19. A method of assembling a piston-slipper assembly for use in a hydraulic apparatus having a plate operably associated with a slipper, the piston-slipper assembly comprising:

a first member having a ball portion and an axially extending neck portion; and a second member having a socket having a circumferential extent greater than 180-degrees for receiving and retaining the ball portion in the socket while allowing swiveling movement of the ball portion, and the second member having a slot in a sidewall;

the method of assembling the piston-slipper assembly including the steps of passing the ball portion into the socket when the ball portion and the axially extending neck portion are in a first orientation relative to the slot, and moving the ball portion and the axially extending neck portion out of the first orientation and into a second orientation thereby precluding removal of the ball portion from the socket.

20. The method of claim 19, wherein after moving the ball portion into the socket no step is necessary for crimping, swaging, or bending of the second member in order to lock the ball portion in the socket.

* * * * *